US006860077B2

(12) United States Patent
Yin

(10) Patent No.: US 6,860,077 B2
(45) Date of Patent: Mar. 1, 2005

(54) HELICAL REBAR STRUCTURE

(75) Inventor: Samuel Yin, Taipei (TW)

(73) Assignee: Runborn Pretech Engineering Co., Ltd., Taipei (TW)

( * ) Notice: Subject to any disclaimer, the term of this patent is extended or adjusted under 35 U.S.C. 154(b) by 0 days.

(21) Appl. No.: 10/441,741

(22) Filed: May 19, 2003

(65) Prior Publication Data

US 2004/0231278 A1 Nov. 25, 2004

(51) Int. Cl.[7] ..... E04H 12/12; E04C 3/34; E04C 5/01

(52) U.S. Cl. ..... 52/649.4; 52/649.6; 52/721.3; 405/239

(58) Field of Search ..... 52/649.2, 649.3, 52/649.4, 649.6, 721.3; 405/239

(56) References Cited

U.S. PATENT DOCUMENTS 1,485,811 A * 3/1924 Pederson ..... 52/649.4
1,708,277 A * 4/1929 Martin ..... 52/649.4
3,501,920 A * 3/1970 Minoru ..... 405/256
4,467,583 A * 8/1984 Hasak ..... 52/649.4
5,542,785 A * 8/1996 Cloud ..... 405/239
6,244,014 B1 * 6/2001 Barmakian ..... 52/736.3

FOREIGN PATENT DOCUMENTS

JP 4-185811 * 7/1992 ..... E02D/3/12

* cited by examiner

*Primary Examiner*—Robert Canfield
(74) *Attorney, Agent, or Firm*—Dellett & Walters

(57) ABSTRACT

A reinforcement structure includes multiple steel bars, a primary spiral hoop enclosing the multiple steel bars, wherein joints of the primary spiral hoop and the steel bars are securely combined, multiple secondary spiral hoops, wherein multiple steel bars are inserted into each of the secondary spiral hoops from outside of the primary spiral hoop to inside of the secondary spiral hoop so that joints between the primary spiral hoop and the secondary spiral hoop are formed. A steel bar is sandwiched between the primary spiral hoop and the secondary spiral hoops and joints of the steel bar to the primary spiral hoop and the secondary spiral hoops are securely combined via steel wires. The reinforcement is thus formed by the steel bars, the primary spiral hoop and the secondary spiral hoops.

5 Claims, 4 Drawing Sheets

HELICAL REBAR STRUCTURE

BACKGROUND OF THE INVENTION

1. Field of the Invention

The present invention relates to a spirally reinforced structure, and more particularly to the reinforcing cage having a primary spiral hoop and multiple secondary spiral hoops securely connected to a contour of the primary spiral hoop. Each of the secondary spiral hoops together with the primary spiral hoop sandwich therebetween reinforcement so that the reinforcing cage with an appropriate length is completed. Thereafter, a column or a beam of a building is formed after poured of concrete, which is efficient and convenient.

2. Description of Related Art

Reinforced Construction (RC) method to form a column, beam uses concrete to resist pressure. Steel bars are used to resist tension and shear force so that the reinforced construction is able to resist an earthquake of a certain degree and loading.

The reinforcing cage normally is formed with multiple primary steel bars, hoops and crossties. The primary steel bars are longitudinally extending in the reinforcing cage. The hoops are latitudinally extending in the reinforcement to confine the outer peripheries of the primary steel bars to reinforce shear resistance of a construction and to accomplish the effectiveness of limiting the primary steel bars. The crossties are latitudinally extending in the reinforcement to reinforce the reinforcement. However, the aforementioned reinforcement still encounter drawbacks when in use and needs to be improved.

1. time consuming and inefficient: due to the trivial details in the employment of the method, the time required is lengthy and is very inconvenient.

2. beside the reinforcements, multiple crossties are required, which increases the inconvenience of the method.

To overcome the shortcomings, the present invention tends to provide an reinforcement structure to mitigate and obviate the aforementioned problems.

SUMMARY OF THE INVENTION

The primary objective of the present invention is to provide an improved reinforcement structure having a primary spiral hoop and multiple secondary spiral hoops. The primary spiral hoop securely is connected to multiple steel bars inside the primary spiral hoop via welding or something else appropriate. Multiple secondary spiral hoops outside the primary spiral hoop are securely connected to multiple steel bars outside the primary spiral hoop.

After the reinforcement put inside the overlap area between the primary spiral hoop and the secondary spiral hoop, the reinforcing cage is formed, which is convenient and time efficient and needs not any cross ties to secure the engagement between the primary spiral hoop and the secondary spiral hoops.

Other objects, advantages and novel features of the invention will become more apparent from the following detailed description when taken in conjunction with the accompanying drawings.

DETAILED DESCRIPTION OF THE PREFERRED EMBODIMENT

Figure 1:
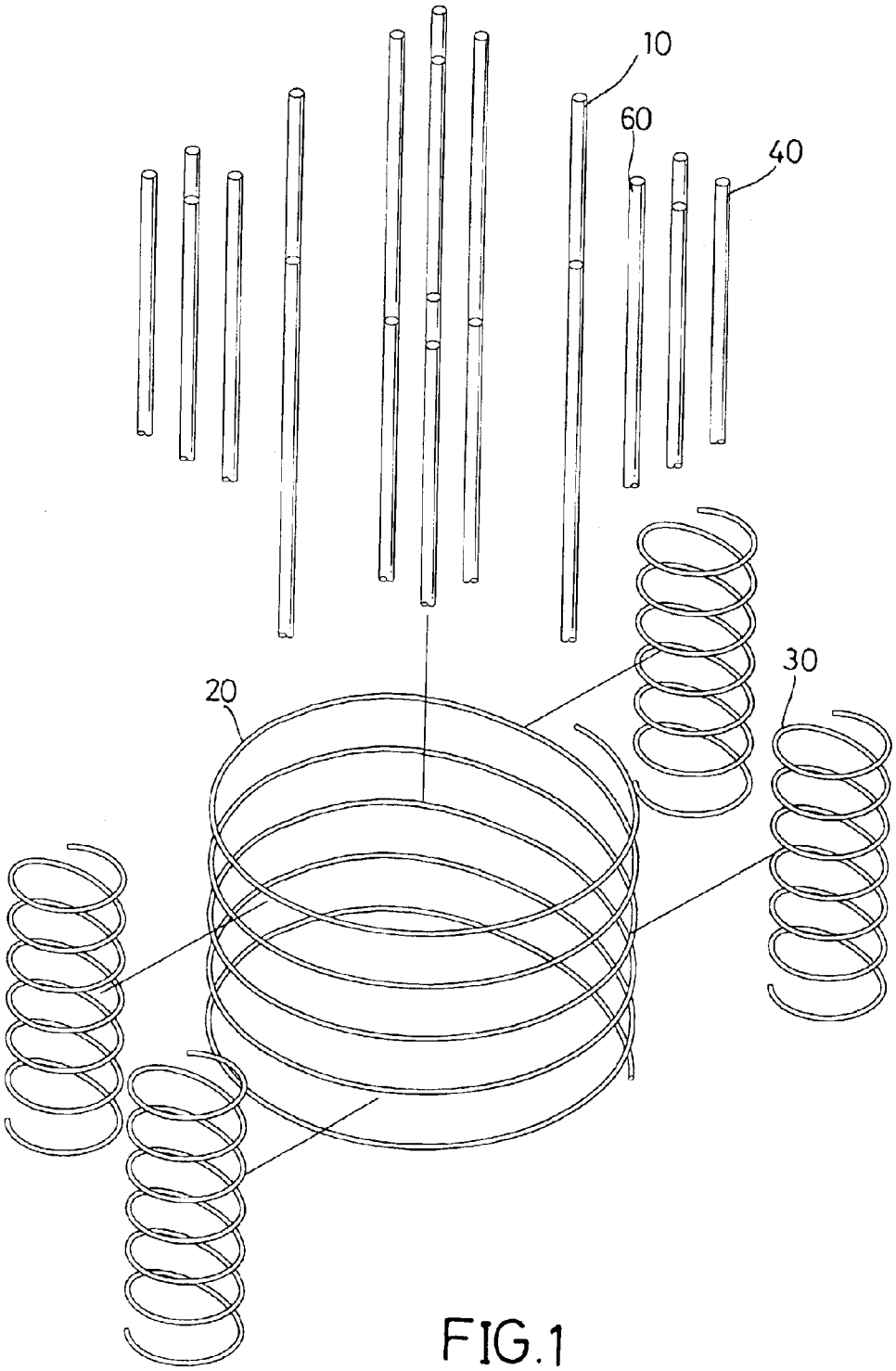
FIG. 1 is an exploded perspective view of the reinforcement of the present invention.
Figure 2:
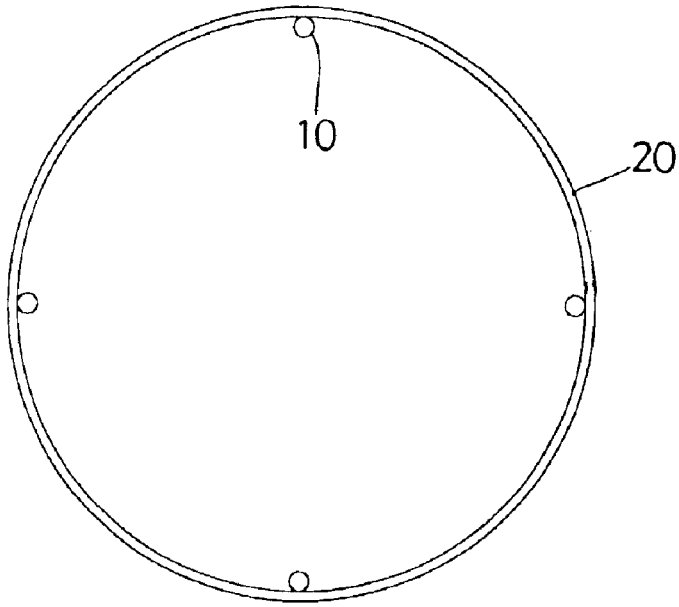
FIG. 2 is a schematic view of the first step of assembling the reinforcement.
Figure 3:
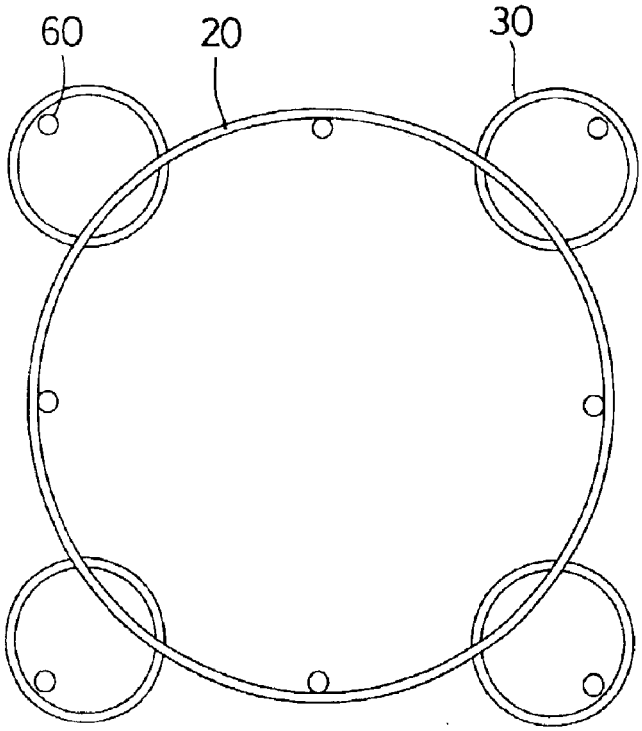
FIG. 3 is a schematic view of the second step of assembling the reinforcement.
Figure 4:
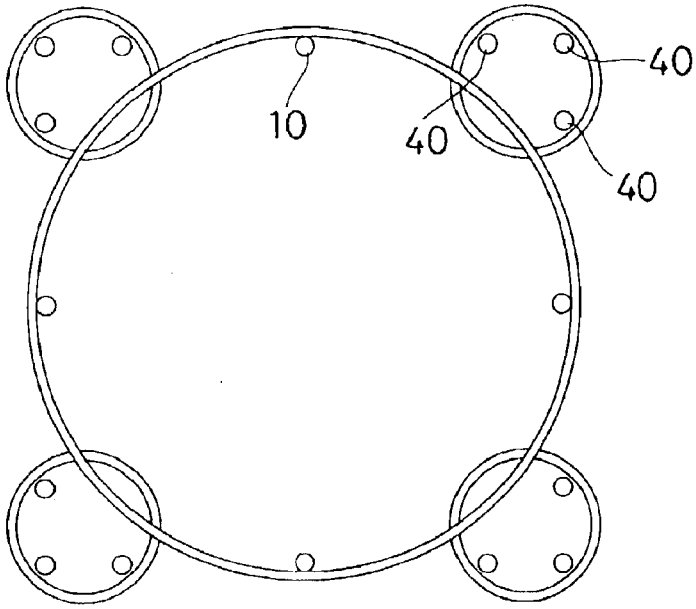
FIG. 4 is a schematic view of the third step of assembling the reinforcement.

The present invention is an assembly structure between a spiral hoop and the steel bars. With reference to FIGS. 1, 2, 3 and 6, the present invention includes following elements:

Multiple steel bars (10,40,60) which extend longitudinally;

A primary spiral hoop (20) which is used to symmetrically enclose the multiple steel bars (10). Joints between the primary spiral hoop (20) and the steel bars (10) are securely combined via steel wires or welding;

Multiple secondary spiral hoops (30) which are respectively interconnected to the primary spiral hoop (20) (as shown in FIG. 4). A steel bar (60) is sandwiched between the primary spiral hoop (20) and the Secondary spiral hoops (30). Joints among the steel bars (60), the primary spiral hoop (20) and the secondary spiral hoops (30) are securely combined via steel wires or welding. The secondary spiral hoops (30) are symmetrically arranged on the primary spiral hoop (20) and the quantity of the secondary spiral hoops (30) is four.

Figure 5:
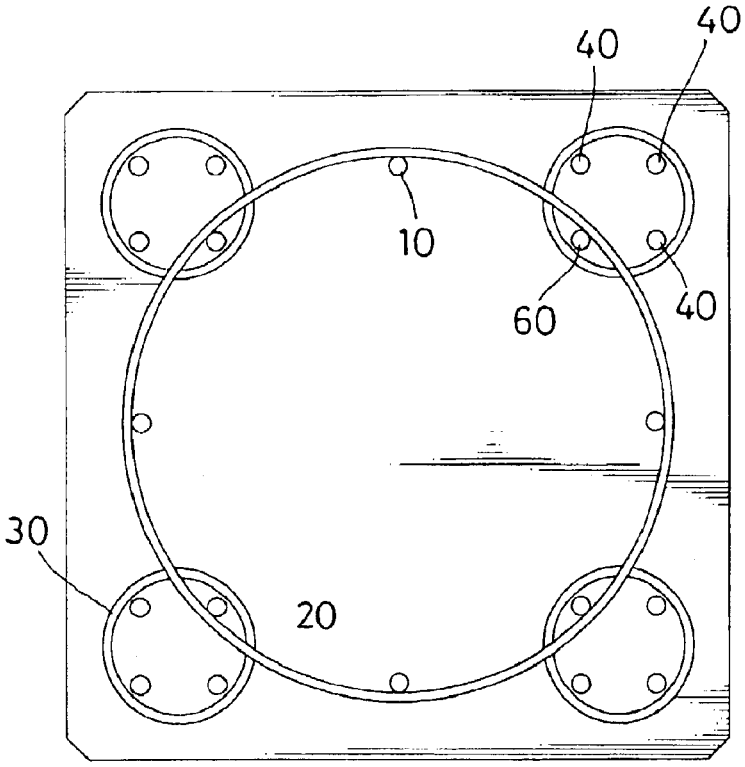
FIG. 5 is a schematic view of the final step of assembling the reinforcement.
Figure 6:
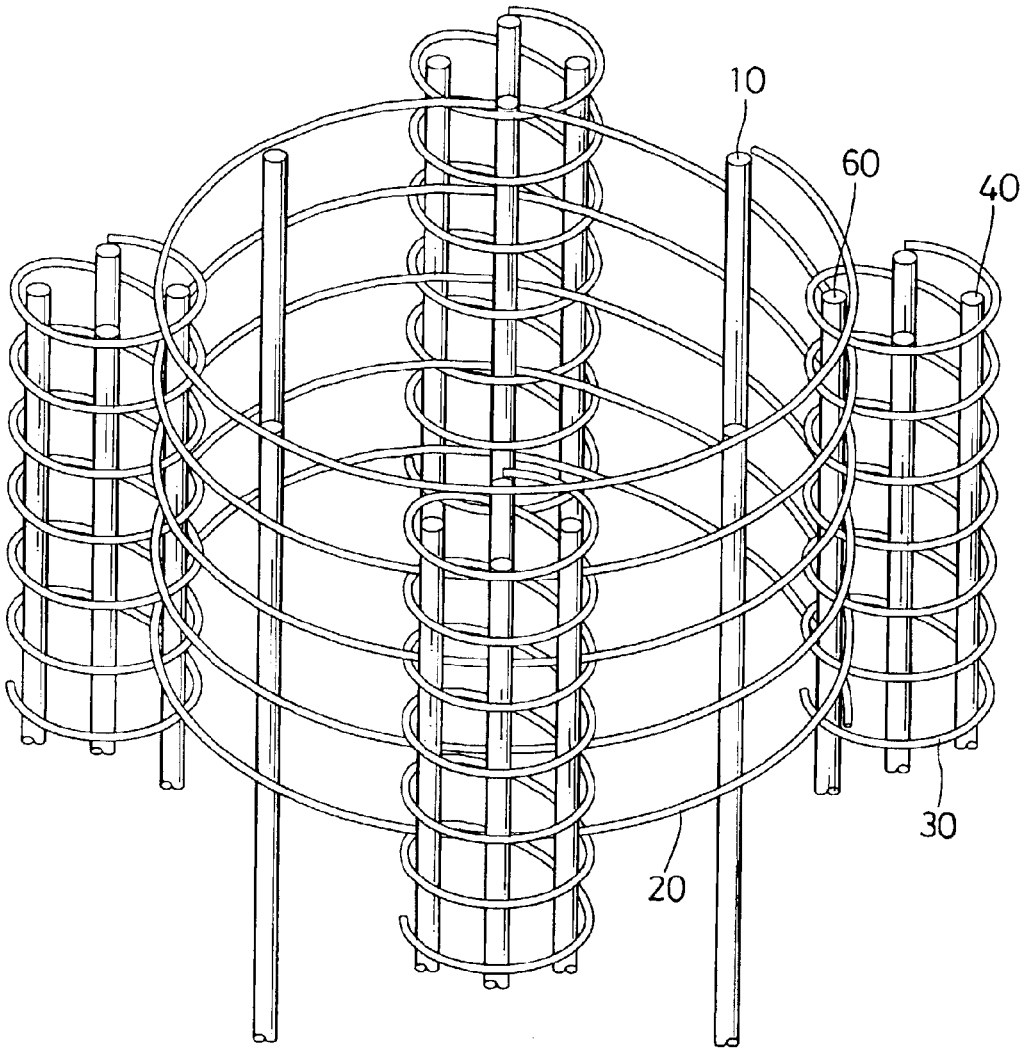
FIG. 6 is a perspective view of the reinforcement in assembly.

With reference to FIGS. 4 and 5, multiple steel bars (40) are inserted into each of the secondary spiral hoops (30). It is to be noted that the insertion of the secondary spiral hoops (30) is sequential so that the steel bars (40, 6O) are symmetrical to each other in the secondary spiral hoop (30). If the length of the beam or column in a building is longer than normal, the operator is able to use multiple primary spiral hoops (20) and multiple secondary spiral hoops (30) to be mounted on the steel bars (10,40,60) to connect to a reinforcement with a proper length. Thereafter, as shown in FIG. 6, concrete is poured into the reinforcement so as to form beams and columns.

The primary objective of the present invention is to use multiple primary spiral hoops (20) to respectively and securely connected to the outside of the steel bars (10,40, 60). The primary spiral hoop (20), the secondary spiral hoops (30) and multiple steel bars (10,40,60) are combined via steel wires or welding. The steel bars (60) are sandwiched between the primary spiral hoop (20) and the secondary spiral hoops (30) and the joints are combined via steel wires or welding to form a reinforcement with an appropriate length.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reinforcement structure comprising:

multiple steel bars;

a primary spiral hoop enclosing the multiple steel bars, wherein joints of the primary spiral hoop and the steel bars are securely combined;

multiple secondary spiral hoops, wherein multiple steel bars are inserted into each of the secondary spiral hoops wherein a steel bar is sandwiched between the primary spiral hoop and the secondary spiral hoops and joints of the steel bar to the primary spiral hoop and the secondary spiral hoops are securely combined via steel wires, whereby the reinforcement is thus formed by the steel bars, the primary spiral hoop and the secondary spiral hoops.

2. The reinforcement as claimed in claim 1, wherein the secondary spiral hoops are symmetrical to each other in the primary spiral hoop.

3. The reinforcement as claimed in claim 2, wherein some steel bars in the secondary spiral hoop are opposite to each other.

4. The reinforcement as claimed in claim 3, wherein steel wires are used to combine the joints of the steel bar to the primary spiral hoop and the secondary spiral hoops.

5. The reinforcement as claimed in claim 3, wherein welding is used to combine the joints of the steel bar to the primary spiral hoop and the secondary spiral hoops.

* * * * *